US008512075B2

(12) United States Patent
Sakamoto

(10) Patent No.: US 8,512,075 B2
(45) Date of Patent: Aug. 20, 2013

(54) CONNECTOR

(75) Inventor: Nobuyuki Sakamoto, Makinohara (JP)

(73) Assignee: Yazaki Corporation, Tokyo (JP)

( * ) Notice: Subject to any disclaimer, the term of this patent is extended or adjusted under 35 U.S.C. 154(b) by 192 days.

(21) Appl. No.: 13/122,661

(22) PCT Filed: Oct. 6, 2009

(86) PCT No.: PCT/JP2009/067420

§ 371 (c)(1),
(2), (4) Date: Apr. 5, 2011

(87) PCT Pub. No.: WO2010/041664

PCT Pub. Date: Apr. 15, 2010

(65) Prior Publication Data

US 2011/0189882 A1 Aug. 4, 2011

(30) Foreign Application Priority Data

Oct. 6, 2008 (JP) ..... 2008-259353
Jan. 23, 2009 (JP) ..... 2009-013423

(51) Int. Cl.
*H01R 13/514* (2006.01)

(52) U.S. Cl.
USPC ..... 439/595; 439/888

(58) Field of Classification Search
USPC ..... 439/752, 884–888, 595
See application file for complete search history.

(56) References Cited

U.S. PATENT DOCUMENTS 4,979,913 A 12/1990 Aiello et al.
5,122,080 A * 6/1992 Hatagishi et al. ..... 439/595
5,240,434 A 8/1993 Yagi et al.
5,403,213 A * 4/1995 Inaba et al. ..... 439/752
5,672,075 A 9/1997 Maejima
5,830,013 A * 11/1998 Saito et al. ..... 439/595
6,183,313 B1 * 2/2001 Kashiyama ..... 439/752
6,280,262 B1 * 8/2001 Tanaka ..... 439/752
6,739,882 B2 * 5/2004 Fuehrer et al. ..... 439/95
6,811,451 B2 * 11/2004 Mase et al. ..... 439/752
7,086,910 B2 * 8/2006 Tanaka et al. ..... 439/752
7,118,426 B2 * 10/2006 Nakamura ..... 439/752
7,347,732 B2 * 3/2008 Ohtaka et al. ..... 439/595
7,828,606 B2 * 11/2010 Singer ..... 439/752

FOREIGN PATENT DOCUMENTS

EP 0756351 A1 1/1997
JP 3-156866 A 7/1991
JP 8-50947 A 2/1996

OTHER PUBLICATIONS

Chinese Office Action Application No. 200980139633.8; Jan. 22, 2013.

* cited by examiner

*Primary Examiner* — Truc Nguyen
(74) *Attorney, Agent, or Firm* — Sughrue Mion, PLLC

(57) ABSTRACT

A connector is provided that can easily insert a connecting terminal into a terminal accommodating hole of a housing and assuredly connect the connecting terminal to a connecting terminal of a mate side.

Under a state that a connecting terminal 2 is held in a terminal accommodating hole 30 of a housing 3, when a slider 33 is slid to the terminal accommodating hole 30 side, a circumferential engaging part 35 abuts on an abutting surface 22*a* to rotate the connecting terminal 2 in the circumferential direction. Thus, the abutting surface 22*a* is held so as to be parallel to a slide direction of the slider 33.

6 Claims, 15 Drawing Sheets

CONNECTOR

TECHNICAL FIELD

The present invention relates to a connector including a connecting terminal having a base end to which an electric wire is connected and an end to which a mate terminal is connected and a housing that accommodates the connecting terminal.

BACKGROUND ART

In various kinds of electronic devices mounted on motor vehicles, various types of connectors are used for connection to a wire harness. Especially, in a multi-polar connector having the large number of poles, an operation for fitting and inserting a connecting terminal into a connector housing thereof (refer it simply to as a housing, hereinafter) is apt to be complicated. In order to improve an efficiency of the fitting and inserting operation, a request is increased for a cylindrical round connecting terminal which is high in its degree of fit and insertion.

As a connector for a usual round connecting terminal of this kind, a connector is known that is disclosed in patent literature 1. The connector 100 for the round connecting terminal includes, as shown in FIG. 18 and FIG. 19, a housing 101 and a female type terminal 102 inserted into the housing 101. The female type terminal 102 inserted into the housing 101. The female type terminal 102 includes a cylindrical terminal connecting part 103 connected to a male type terminal of a mate side which is not shown in the drawing, a cylindrical neck part 104 having a small diameter and an electric wire connecting part 108 including one pair of electric wire caulking parts 106 and 106 which have substantially the same diameter as that of a base part 105 of the terminal connecting part 103. In a stepped part between the base part 105 of the terminal connecting part 103 and the neck part 104, an annular groove part 109 is formed. The housing 101 is provided with terminal accommodating holes 110 and 111 formed in two upper and lower stages for accommodating the female type terminal 102 and inserting and connecting the male type terminal and an engaging lance 112 formed substantially at an intermediate position of the terminal accommodating holes 110 and 111. An end of a head part 113 of an engaging lance 112 is fitted to the annular groove part 109.

According to the above-described structure, when the female type terminal 102 is inserted into the terminal accommodating holes 110 and 111, since the head part 113 of the engaging lance 112 enters the part of the neck part 104, the female type terminal 102 is engaged with the housing 101. Under this state, when the female type terminal 102 is pulled in a direction for drawing out the female type terminal 102 from the housing 101, the end of the head part 113 of the engaging lance 112 is fitted to the annular groove part 109 and an entire part of the engaging lance 112 is displaced in the axial direction of the female type terminal 102. Accordingly, the female type terminal 102 is engaged with the housing 101 without breaking the engaging lance 112, so that the female type terminal can be prevented from slipping out.

CITATION LIST

Patent Literature

Patent Literature 1: Japanese Patent Publication No. 08-50947 A

SUMMARY OF INVENTION

Technical Problem

However, in the connector 100 for the round connecting terminal of the patent literature 1, when the male type terminal of a mate side connected to the terminal connecting part 103 has a directional performance or orientation, for instance, the male type terminal has a flat plate form, with respect to a rotating position in the circumferential direction, if the female type terminal 102 is not set at a prescribed rotating position relative to the male type terminal, a problem arises that a spring member which holds a connecting state to the male type terminal does not effectively operate to cause an imperfect connection to the male type terminal.

Thus, the present invention is devised to solve the above-described problem and it is an object of the present invention to provide a connector that can easily insert a connecting terminal into a terminal accommodating hole of a housing and assuredly connect the terminals together even when the connecting terminal of a mate side has a directional performance or orientation with respect to a rotating position in the circumferential direction.

Solution to Problem

According to a first aspect of the present invention, a connector includes a connecting terminal having an axial positioning part provided with a recessed part formed on an outer peripheral surface and a housing having a terminal accommodating hole in which the connecting terminal is accommodated and an axial engaging part formed so as to protrude and retreat in the terminal accommodating hole and so as to be engaged with the axial positioning part, the axial positioning part being engaged with the axial engaging part to hold the connecting terminal in the terminal accommodating hole when the connecting terminal is inserted into the terminal accommodating hole, and is characterized in that the connecting terminal has a circumferential positioning part formed in a shape of width across flats which includes abutting surfaces of two parallel surfaces forming the shape of width across flats, the housing includes a slide hole which is orthogonal to the terminal accommodating hole and communicates with the terminal accommodating hole and a slider arranged so as to freely slide in the slide hole, the slider includes a circumferential engaging part protruding in the terminal accommodating hole, when the slider is slid to the terminal accommodating hole side under a state that the connecting terminal is held in the terminal accommodating hole, the circumferential engaging part abuts on the abutting surface to rotate the connecting terminal in the circumferential direction and the abutting surface is held so as to be parallel to a regulating surface forming the circumferential engaging part.

According to a second aspect of the present invention, a connector is, in the first aspect, characterized in that the connecting terminal has a substantially circular form in section, the axial positioning part has a continuous annular groove along the circumferential direction, the axial positioning part and the circumferential positioning part are adjacently arranged in the axial direction, the regulating surface is formed in parallel with a slide direction of the slider and when the slider is slid to the terminal accommodating hole side under a state that the connecting terminal is held in the terminal accommodating hole, the abutting surface is held so as to be parallel to the slide direction of the slider.

According to a third aspect of the present invention, a connector is, in the first aspect, characterized in that the connecting terminal has a substantially circular form in section, the axial positioning part is set in a stepped part between the abutting surface and an outer peripheral surface of the connecting terminal, the regulating surface is formed so as to be orthogonal to the slide direction of the slider, and when the slider is slid to the terminal accommodating hole side under a state that the connecting terminal is held in the terminal accommodating hole, the abutting surface is held so as to be orthogonal to the slide direction of the slider.

Advantageous Effects of Invention

According to the first aspect of the present invention, after the connecting terminal is inserted into the terminal accommodating hole of the housing, when the slider provided in the housing is moved to the terminal accommodating hole side, the circumferential engaging part abuts on the abutting surface to rotate the connecting terminal in the circumferential direction and the abutting surface is held so as to be parallel to the regulating surface forming the circumferential engaging part of the slider. Thus, when the connecting terminal is attached to the housing, the connecting terminal can be easily inserted into the terminal accommodating hole of the housing without caring about a directional performance or orientation with respect to a rotating position in the circumferential direction, and the slider can be moved to set the connecting terminal at the prescribed rotating position.

According to the second aspect of the present invention, since the connecting terminal has a substantially circular form in section and the axial positioning part is the annular groove along the circumferential direction, there is no protruding part in the circumferential direction, so that the connecting terminal can be more smoothly rotated in the circumferential direction. Further, since a clearance between the connecting terminal and an inner wall of the terminal accommodating hole can be formed to be small, the connecting terminal accommodated in the terminal accommodating hole does not shake. Thus, a connection to the terminal of the mate side can be assuredly achieved.

Further, since the axial positioning part and the circumferential positioning part are adjacently arranged in the axial direction, when the connecting terminal is inserted by the prescribed dimension into the terminal accommodating hole of the housing, the axial positioning part is engaged with the axial engaging part to prevent a movement of the connecting terminal in the axial direction. Accordingly, the connecting terminal can be positioned in the axial direction and can be prevented from slipping out.

According to the third aspect of the present invention, since the connecting terminal has a substantially circular form in section and the axial positioning part is the annular groove along the circumferential direction, there is no protruding part in the circumferential direction, so that the connecting terminal can be more smoothly rotated in the circumferential direction. Further, since a clearance between the connecting terminal and an inner wall of the terminal accommodating hole can be formed to be small, the connecting terminal accommodated in the terminal accommodating hole does not shake. Thus, a connection to the terminal of the mate side can be assuredly achieved.

Further, since the axial positioning part is set in the stepped part between the abutting surface and the outer peripheral surface of the connecting terminal, an axial dimension of the connecting terminal can be shortened to make an entire part of the connector compact.

DESCRIPTION OF EMBODIMENTS

Embodiment 1

Figure 1:
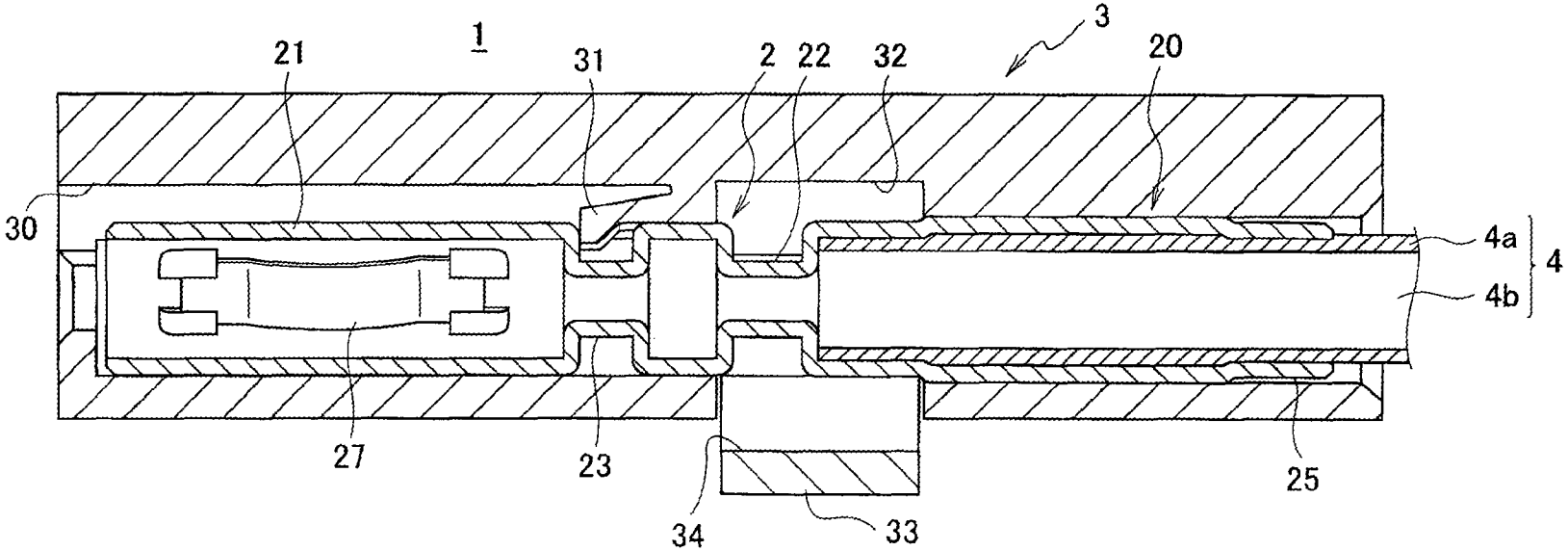
FIG. 1 shows a first exemplary embodiment of the present invention and a sectional view of a connector along an axial direction illustrating a state before a slider moves.
Figure 2:
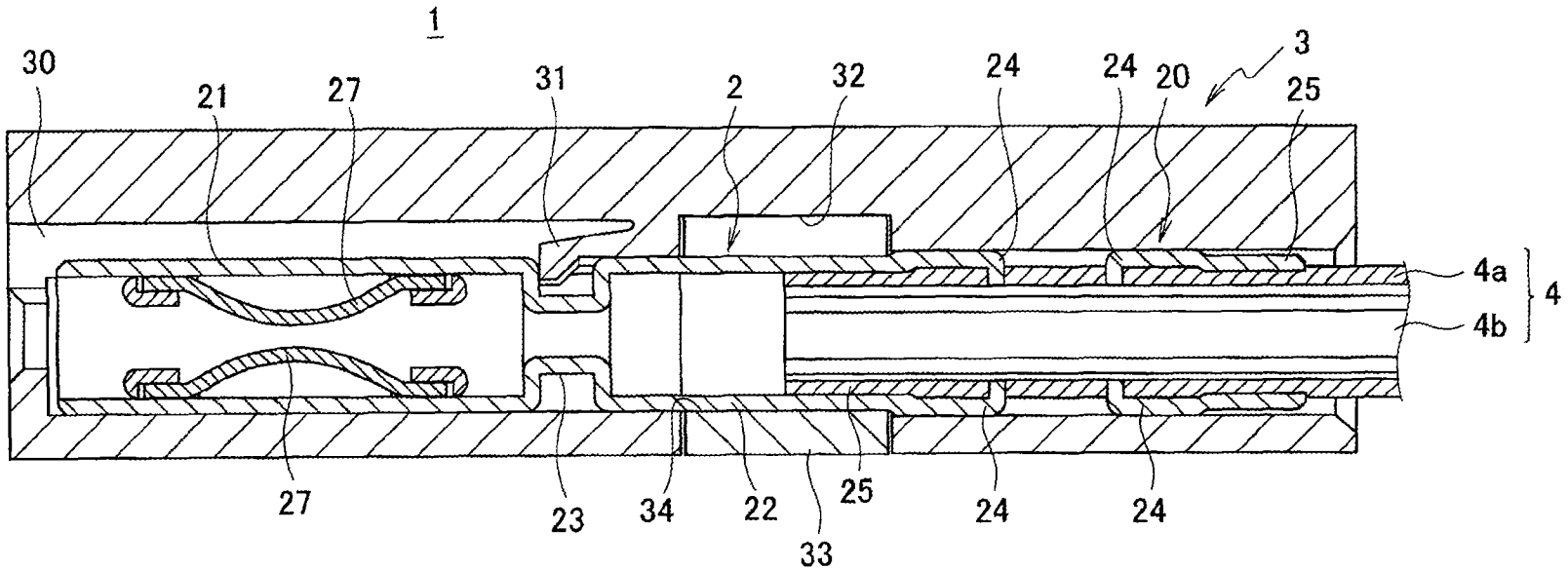
FIG. 2 shows the first exemplary embodiment of the present invention and a sectional view of the connector along the axial direction illustrating a state that the slider moves to a moving end.
Figure 3:
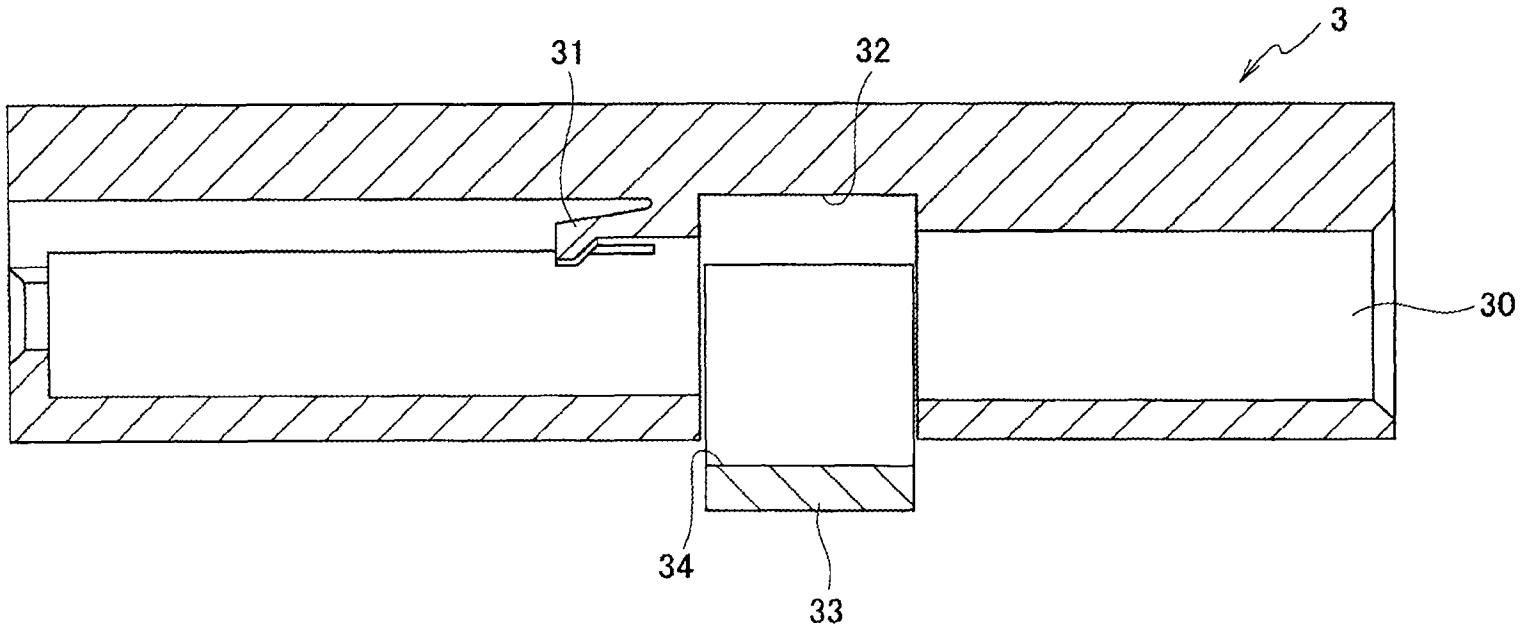
FIG. 3 shows the first exemplary embodiment of the present invention and a sectional view of a housing.
Figure 4:
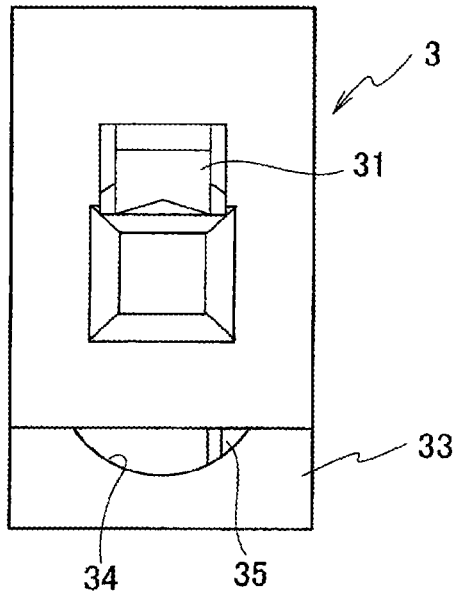
FIG. 4 shows the first exemplary embodiment of the present invention and a front view of the housing.
Figure 5:
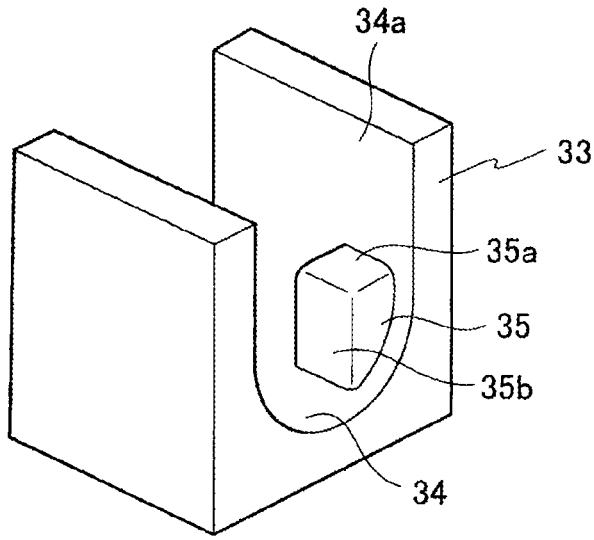
FIG. 5 shows the first exemplary embodiment of the present invention and a perspective view of the slider.
Figure 6:
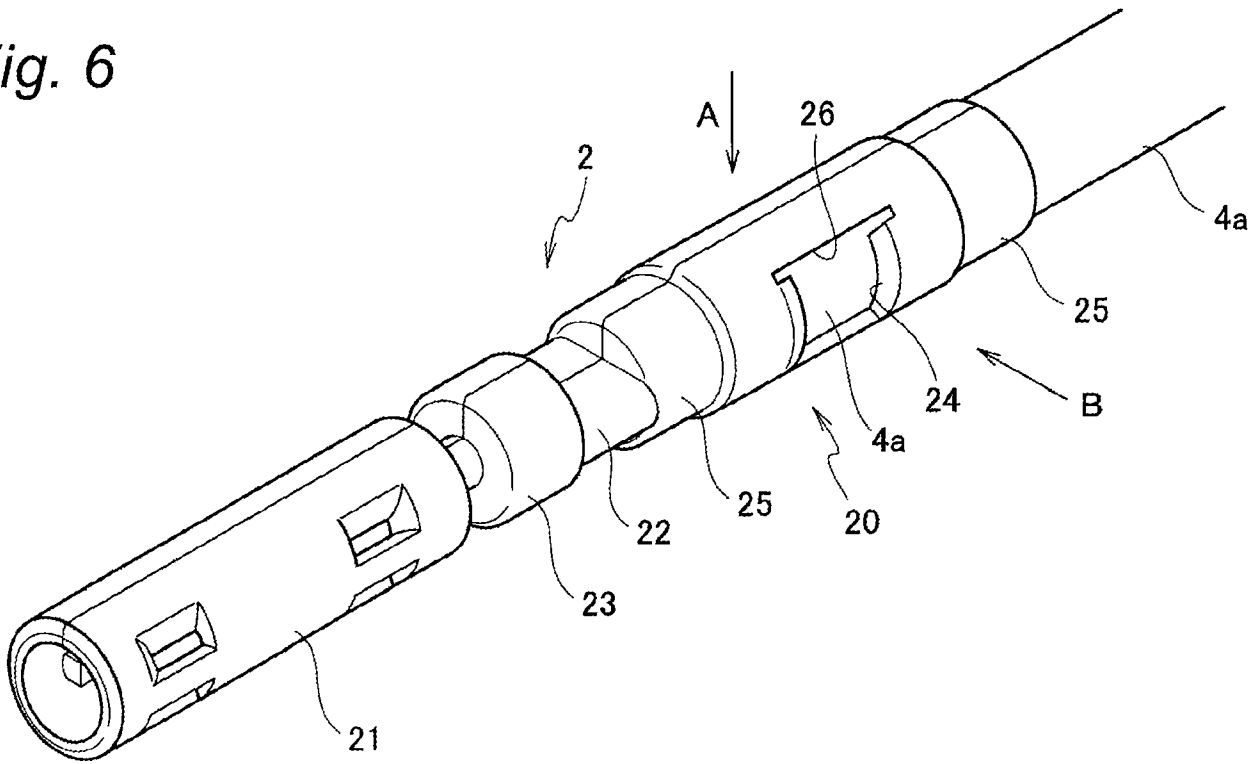
FIG. 6 shows the first exemplary embodiment of the present invention and a perspective view of a round connecting terminal.
Figure 7:
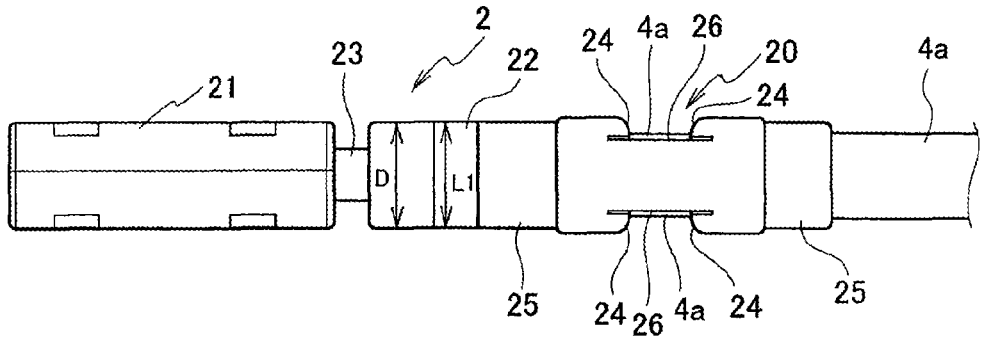
FIG. 7 shows the first exemplary embodiment of the present invention and a view of the round connecting terminal seen from a direction A in FIG. 6.
Figure 8:
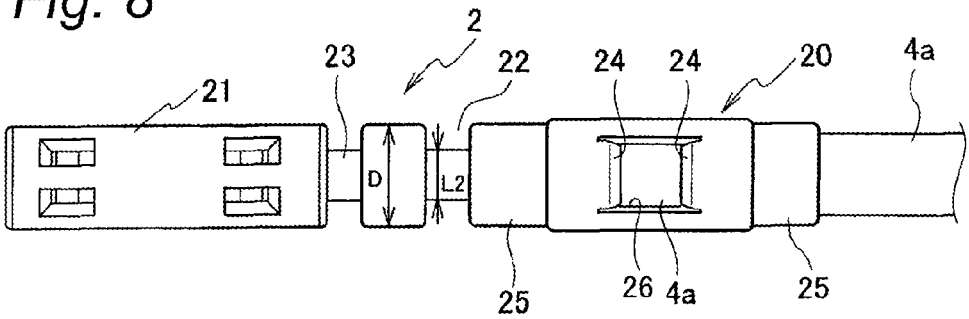
FIG. 8 shows the first exemplary embodiment of the present invention and a view of the round connecting terminal seen from a direction B in FIG. 6.
Figure 9A:
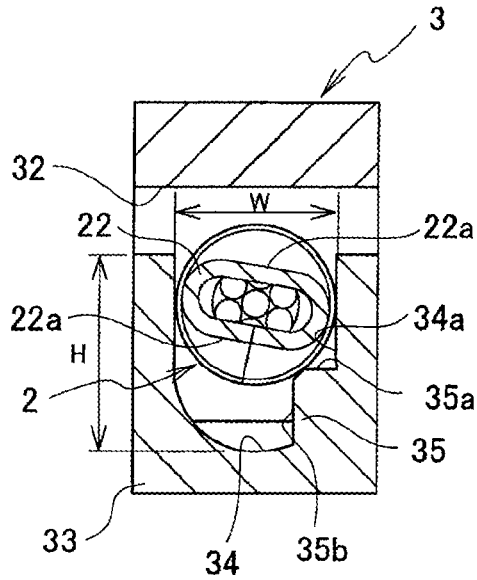
FIG. 9A shows the first exemplary embodiment of the present invention and a sectional view of the slider and an engaging part that illustrates a state before the slider moves.
Figure 9B:
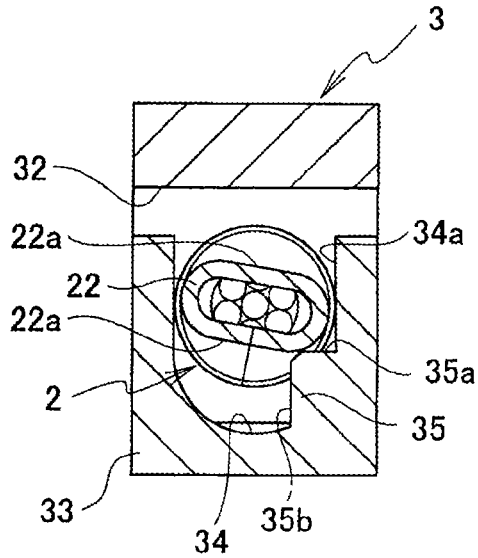
FIG. 9B shows the first exemplary embodiment of the present invention and a sectional view of the slider and the engaging part which illustrates a state that the slider begins to be engaged with the engaging part.
Figure 9C:
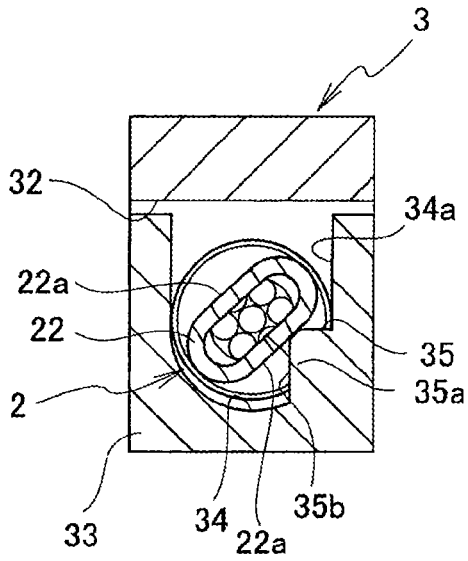
FIG. 9C shows the first exemplary embodiment of the present invention and a sectional view of the slider and the engaging part which illustrates a state that the slider applies a turning force or torque to the engaging part.
Figure 9D:
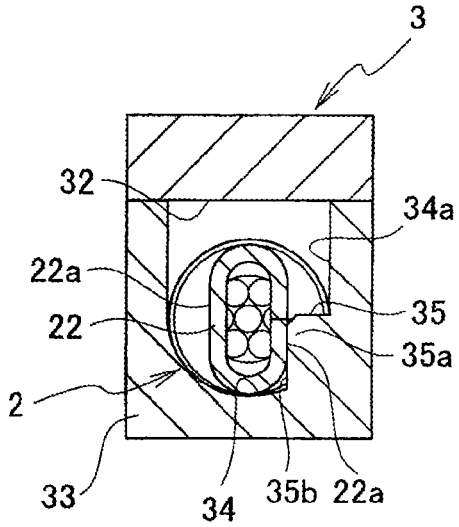
FIG. 9D shows the first exemplary embodiment of the present invention and a sectional view of the slider and the engaging part which illustrates a state that the slider moves to the moving end.

One exemplary embodiment of the present invention will be described below by referring to the drawings. FIG. 1 to FIG. 9D show a first exemplary embodiment of the present invention. FIG. 1 is a sectional view of a connector along an axial direction showing a state before a slider moves. FIG. 2 is a sectional view of the connector along the axial direction illustrating a state that the slider moves to a moving end. FIG. 3 is a sectional view of a housing. FIG. 4 is a front view of the housing. FIG. 5 is a perspective view of the slider. FIG. 6 is a perspective view of a round connecting terminal. FIG. 7 is a view of the round connecting terminal seen from a direction A in FIG. 6. FIG. 8 is a view of the round connecting terminal seen from a direction B in FIG. 6. FIG. 9A is a sectional view of the slider and an engaging part that illustrates a state before the slider moves. FIG. 9B is a sectional view of the slider and the engaging part which illustrates a state that the slider begins to be engaged with the engaging part. FIG. 9C is a sectional view of the slider and the engaging part which illustrates a state that the slider applies a turning force or torque to the engaging part. FIG. 9D is a sectional view of the slider and the engaging part which illustrates a state that the slider moves to the moving end.

A connector 1 of the present exemplary embodiment includes, as shown in FIG. 1 to FIG. 9D, a round connecting terminal (a female type connecting terminal) 2 formed substantially in a cylindrical shape and a housing 3 made of an integrally formed resin material and having a terminal accommodating hole 30 to which the round connecting terminal 2 is fitted and inserted.

The round connecting terminal 2 includes an electric wire connecting part 20 caulked and connected to one end of an electric wire 4 having a circular section in a base end side (a right side of FIG. 7 and FIG. 8) of a terminal inserting direction and a terminal connecting part 21 connected to a male type connecting terminal (not shown in the drawing) of a mate side in an end side (a left side of FIG. 7 and FIG. 8) of the terminal inserting direction.

The electric wire connecting part 20 includes a plurality of pressure welding blades 24 passing through a coating part 4*a* of the electric wire 4 and one pair of electric wire holding parts 25 pressure-welded to the coating part 4*a*. The one pair of electric wire holding parts 25 are arranged in the base end side and the end side of the pressure welding blades 24 in the terminal inserting direction. The pressure welding blades 24 are formed by forming an opening 26 in the electric wire connecting part 20 and partly bending its edges inside. The pressure welding blades 24 are respectively arranged in the base end side and the end side of the opening 26 in the terminal inserting direction. The other one pair of pressure welding blades 24 are arranged in an opposite side with respect to an axis of the electric wire connecting part 20 as a boundary.

Between the electric wire connecting part 20 and the terminal connecting part 21, are adjacently provided a circumferential positioning part 22 on which a below-described slider 33 abuts and is engaged and an annular groove part 23 formed continuously to an outer periphery of the round connecting terminal 2 as an axial positioning part. The circumferential positioning part 22 is formed in the shape of width across flats and has a section of an elliptical form which includes two parallel surfaces along the diametrical direction of the round connecting terminal 2 and abutting surfaces 22*a* forming the shape of width across flats on an outer periphery. A longitudinal dimension L1 of the circumferential positioning part 22 is set to be substantially the same as a diameter D of the round connecting terminal 2 and a dimension L2 of the circumferential positioning part 22 in a transverse direction is set to be smaller than the diameter D of the round connecting terminal 2.

The housing 3 includes, in the terminal accommodating hole 30, an engaging lance 31 having a flexible arm 31*a* with a flexibility as an axial engaging part and an engaging part 31*b* provided at an end of the flexible arm 31*a* and set so as to protrude in and retreat from the terminal accommodating hole 30 when the flexible arm 31*a* is bent. Then, when the round connecting terminal 2 is inserted into the terminal accommodating hole 30, the engaging lance 31 retreats to a wall surface of the terminal accommodating hole 30, and when the groove part 23 appears, the engaging lance protrudes in the terminal accommodating hole 30 to be engaged with the groove part 23. Further, in the housing 3, a slide hole 32 is provided which is orthogonal to and communicates with the terminal accommodating hole 30. Then, the slider 33 is arranged so as to slide in the slide hole 32.

The slider 33 is opened to the slide hole 32 and extended along the axial direction of the round connecting terminal 2 and has a U shaped groove 34 formed so as to accommodate the circumferential positioning part 22. In one side wall 34*a* of the U shaped groove 34, a circumferential engaging part 35 is provided which protrudes in the U shaped groove 34. The U shaped groove 34 has a width dimension W slightly larger than the above-described dimension L1 of the circumferential positioning part 22. An end surface 35*a* of the circumferential engaging part 35 is set at a position ½ times or more as high as the dimension L1 from a bottom of the U shaped groove 34 so as to be orthogonal to a moving direction of the slider 33. Further, a regulating surface 35*b* of the circumferential engaging part 35 is set at a position about ½ times as long as the dimension L2 from the side wall 34*a* so as to be parallel to the moving direction of the slider 33. The round connecting terminal 2 is set so as to freely rotate until the abutting surface 22*a* of the circumferential positioning part 22 is parallel to a slide direction of the slider 33 in the U shaped groove 34.

In the above-described structure, initially, after one end of the electric wire 4 is inserted into the electric wire connecting part 20, the electric wire connecting part 20 is caulked to form the electric connecting part in a cylindrical shape along the electric wire. Thus, since the electric wire holding parts 25 are pressure-welded to the coating part 4*a* of the electric wire 4, a connecting state of the electric wire connecting part 20 and the electric wire 4 is held. Further, the pressure welding blades 24 are pressure-welded to the electric wire 4 to pass through the coating part 4*a*, so that the round connecting terminal 2 is electrically connected to a conductor part 4*b* of the electric wire 4 through the pressure welding blades 24.

When the round connecting terminal 2 assembled in such a way is inserted into the terminal accommodating hole 30 of the housing 3 by a prescribe dimension, the annular groove part 23 formed on the outer periphery of the round connecting terminal 2 is engaged with the engaging lance 31 in the terminal accommodating hole 30 to prevent the round connecting terminal 2 from slipping out from the terminal accommodating hole 30. Further, as shown in FIG. 9A, the circumferential positioning part 22 of the round connecting terminal 2 is accommodated in the U shaped groove 34 of the slider 33. Then, as shown in FIG. 9B, for instance, when the longitudinal direction of the circumferential positioning part 22 is substantially horizontal, if the slider 33 is moved upward in the terminal accommodating hole 30 side, the abutting surface 22*a* of the circumferential positioning part 22 abuts on the circumferential engaging part 35 in the U shaped groove 34 to apply a counterclockwise turning force or torque. Thus, the round connecting terminal 2 rotates on an axis as a center. Further, when the slider 33 is moved, as shown in FIG. 9C, the circumferential positioning part 22 rotates in the U shaped groove 34. Finally, when the slider 33 is moved to a moving end, as shown in FIG. 9D, the circumferential positioning part 22 abuts on the regulating surface 35*b* of the circumferential engaging part 35. Thus, the abutting surface 22*a* of the circumferential positioning part 22 is arranged along the slide direction of the slider 33 and the round connecting terminal 2 is set at a prescribed rotating position.

As described above, in the present exemplary embodiment, when the round connecting terminal 2 is attached to the housing 3, the round connecting terminal 2 can be easily inserted into the terminal accommodating hole 30 of the housing 3 without caring about a directional performance or orientation of a rotating position in the circumferential direction. Further, the slider 33 is moved to set the round connecting terminal 2 at the prescribed rotating position, so that a spring member 27 effectively operates which holds a connecting state tope male type terminal of the mate side. Accordingly, the terminals can be assuredly connected together by the spring member 27.

Further, since the axial groove part 23 and the circumferential positioning part 22 are adjacently arranged in the axial direction, when the round connecting terminal 2 is inserted by the prescribed dimension into the terminal accommodating hole 30 of the housing 3, the annular groove part 23 formed on the outer periphery of the round connecting terminal 2 is engaged with the engaging lance 31 in the terminal accommodating hole 30 to prevent a movement of the round connecting terminal 2 in the axial direction. Accordingly, the round connecting terminal 2 can be positioned in the axial direction and can be prevented from slipping out. In addition thereto, when the slider 33 is slid, since there is no fear that the round connecting terminal 2 slips out from the housing 3, even if a plurality of round connecting terminals 2 are rotated in the circumferential direction by one slider, the round connecting terminals can be easily rotated so that an arrangement work of the round connecting terminal 2 may be simplified.

Further, since the round connecting terminal 2 has a substantially circular form in section and the axial positioning part is the annular groove along the circumferential direction, there is no protruding part in the circumferential direction, so that the connecting terminal can be more smoothly rotated in the circumferential direction. Further, since a clearance between the round connecting terminal 2 and an inner wall of the terminal accommodating hole 30 can be formed to be small, the round connecting terminal 2 accommodated in the terminal accommodating hole 30 does not shake. Thus, a connection to the male type terminal of the mate side can be assuredly achieved.

Further, since the electric wire connecting part 20 is formed in a cylindrical shape and an occurrence of an edge on a surface due to a caulking work is suppressed, the round connecting terminal 2 can smoothly pass through a seal material (not shown in the drawing) when the round connecting terminal 2 is attached to and detached from the housing (not shown in the drawing) and the seal material is not broken to hold a sealing performance. Accordingly, the seal material does not need to be exchanged and the round connecting terminal 2 can be attached to and detached from the housing. Further, the coating part 4*a* of the electric wire 4 does not need to be removed (what is called, a peeling) and the round connecting terminal 2 can be electrically connected to the conductor part 4*b* of the electric wire 4. Accordingly, a labor can be more reduced and a cost can be more suppressed than a case that the coating part 4*a* is previously removed.

In the present invention, the axial positioning part of the round connecting terminal 2 is the annular groove part 23 which is formed continuously to the outer periphery of the round connecting terminal 2, however, when an annular protruding part is used, the same operational effects can be obtained.

Embodiment 2

Figure 10:
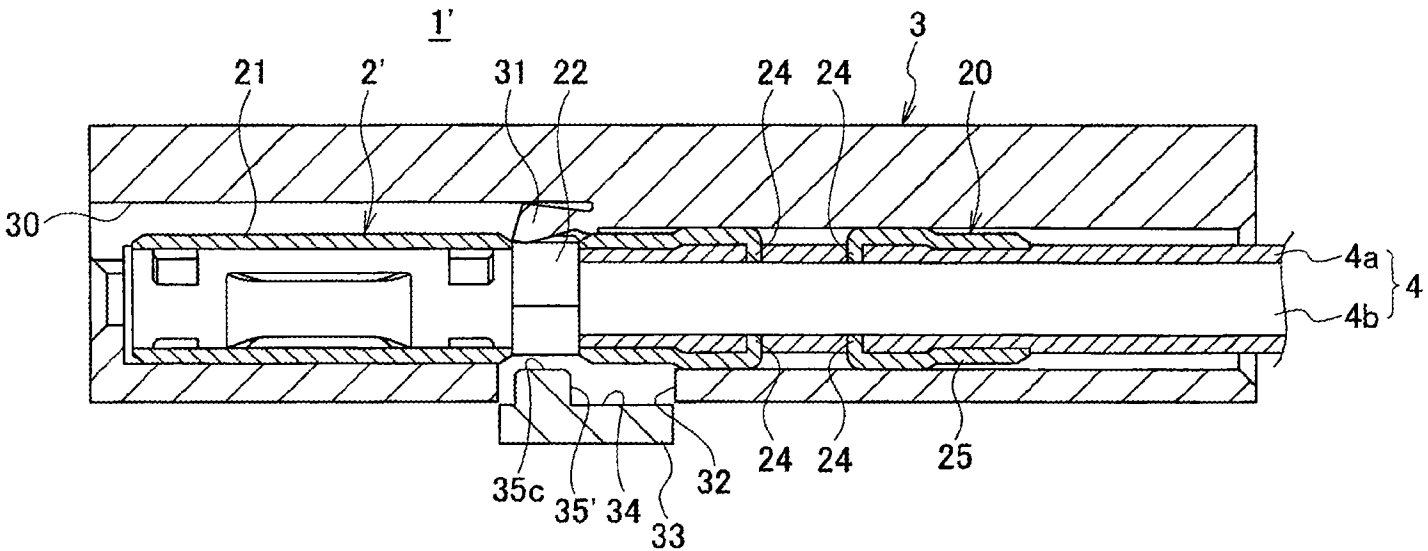
FIG. 10 shows a second exemplary embodiment of the present invention and a sectional view of a connector along an axial direction illustrating a state before a slider moves.
Figure 11:
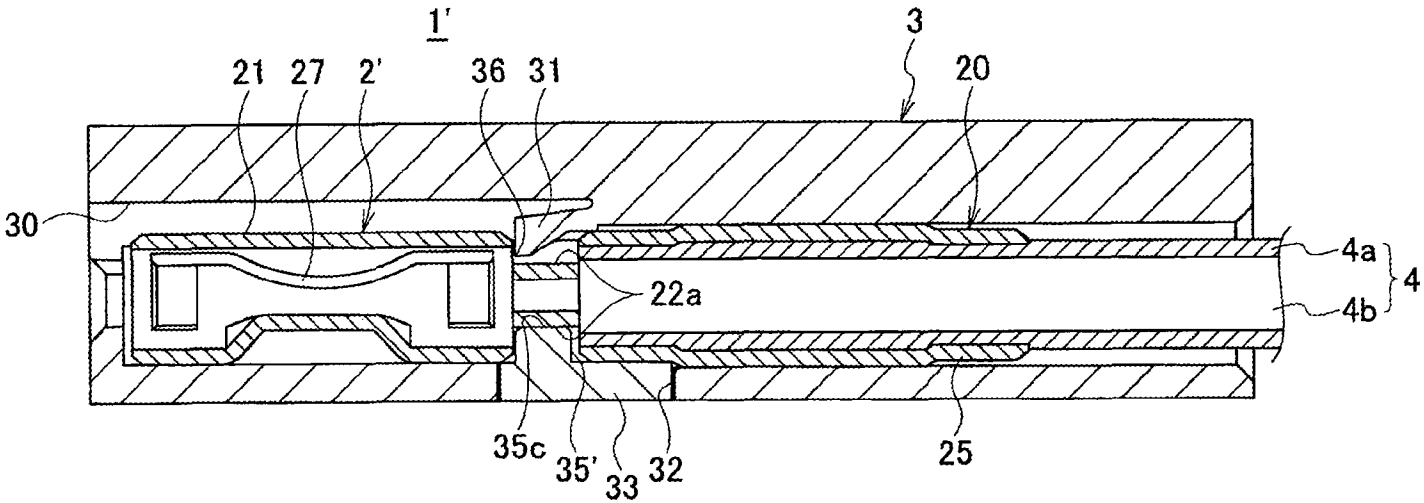
FIG. 11 shows the second exemplary embodiment of the present invention and a sectional view of the connector along the axial direction illustrating a state that the slider moves to a moving end.
Figure 12:
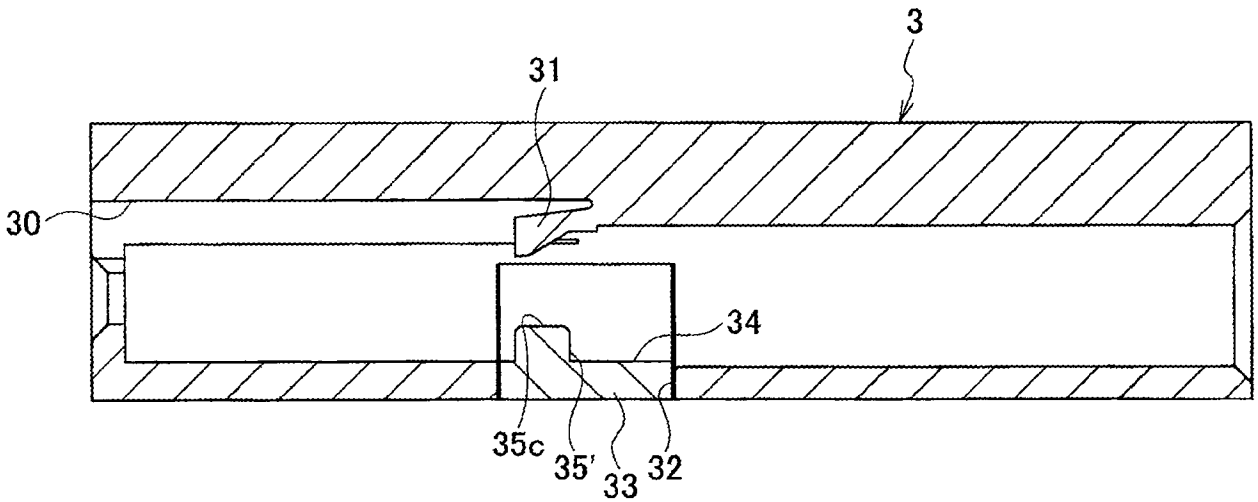
FIG. 12 shows the second exemplary embodiment of the present invention and a sectional view of a housing.
Figure 13:
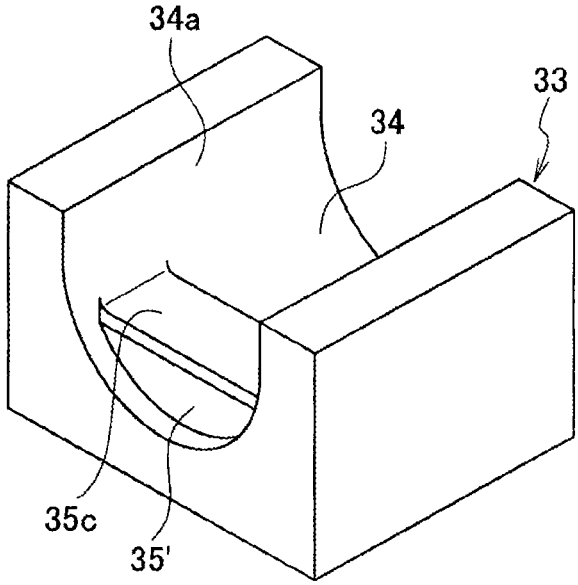
FIG. 13 shows the second exemplary embodiment of the present invention and a perspective view of the slider.
Figure 14:
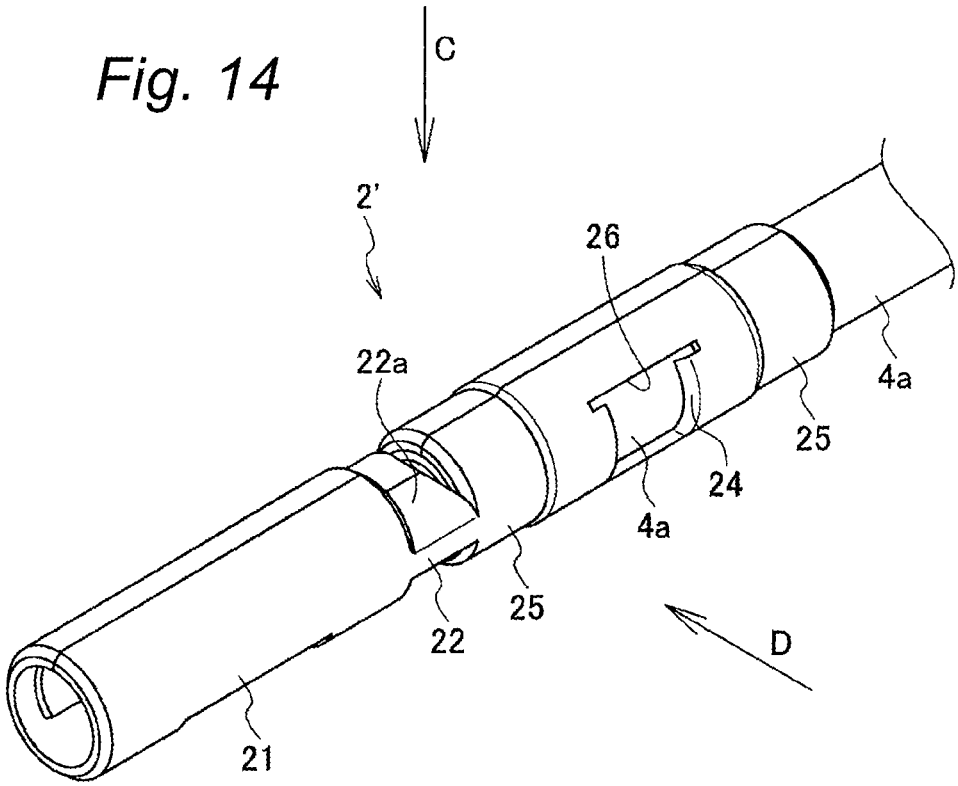
FIG. 14 shows the first exemplary embodiment of the present invention and a perspective view of a round connecting terminal.
Figure 15:
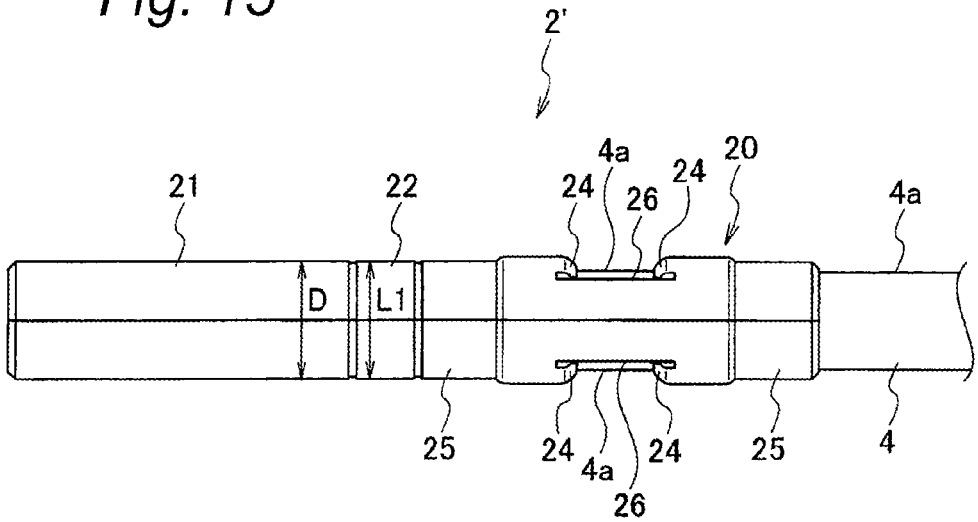
FIG. 15 shows the second exemplary embodiment of the present invention and a view of the round connecting terminal seen from a direction C in FIG. 14.
Figure 16:
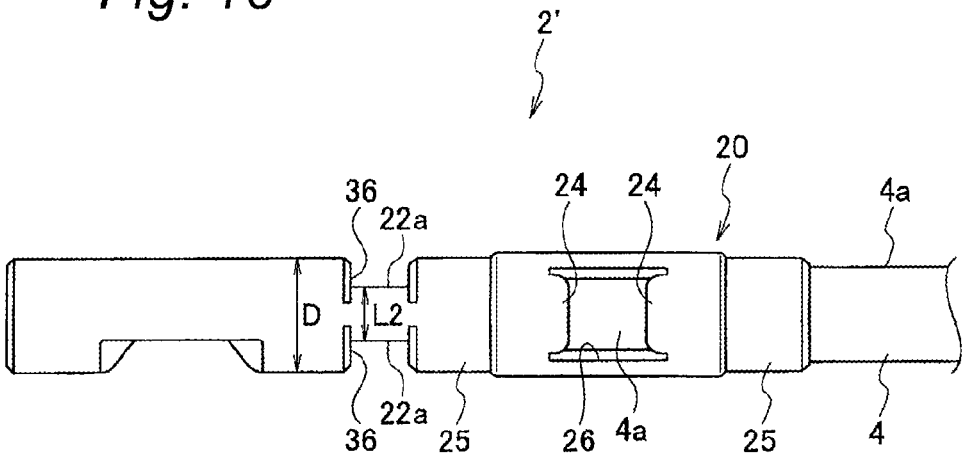
FIG. 16 shows the second exemplary embodiment of the present invention and a view of the round connecting terminal seen from a direction D in FIG. 14.
Figure 17A:
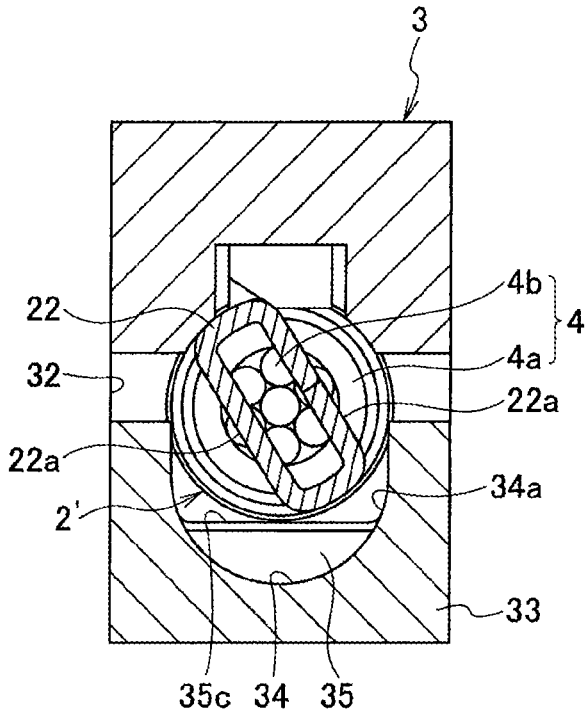
FIG. 17A shows the second exemplary embodiment of the present invention and a sectional view of the slider and an engaging part that illustrates a state before the slider moves.
Figure 17B:
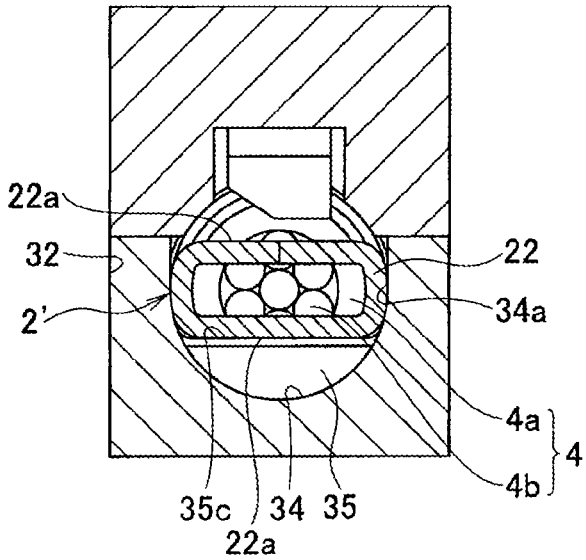
FIG. 17B shows the second exemplary embodiment of the present invention and a sectional view of the slider and the engaging part which illustrates a state that the slider moves to the moving end.
Figure 18:
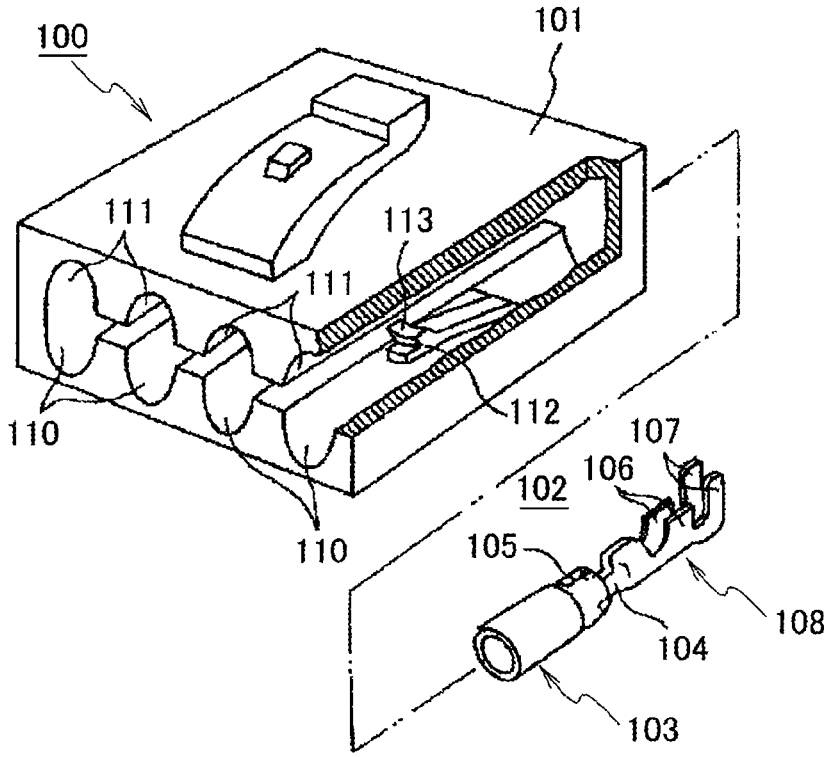
FIG. 18 is a sectional view showing a connector for a round connector terminal of a usual example.
Figure 19:
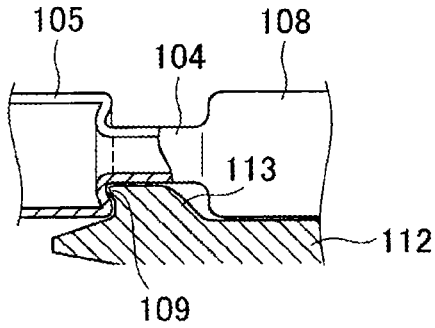
FIG. 19 is a sectional view that enlarges and shows a main part of the connector for the round connecting terminal of the usual example.

A second exemplary embodiment will be described by referring to the drawings. FIG. 10 to FIG. 17B show the second exemplary embodiment of the present invention. FIG. 10 is a sectional view of a connector along an axial direction illustrating a state before a slider moves. FIG. 11 is a sectional view of the connector along the axial direction illustrating a state that the slider moves to a moving end. FIG. 12 is a sectional view of a housing. FIG. 13 is a perspective view of the slider. FIG. 14 is a perspective view of a round connecting terminal. FIG. 15 is a view of the round connecting terminal seen from a direction C in FIG. 14. FIG. 16 is a view of the round connecting terminal seen from a direction D in FIG. 14. FIG. 17A is a sectional view of the slider and an engaging part that illustrates a state before the slider moves. FIG. 17B is a sectional view of the slider and the engaging part which illustrates a state that the slider moves to the moving end.

In the second exemplary embodiment of FIG. 10 to FIG. 17B, the same structures as those of the above-described first exemplary embodiment shown in FIG. 1 to FIG. 9D will be designated by the same reference numerals and a detailed description thereof will be omitted.

A large difference in a round connecting terminal 2' as a connecting terminal between the structure of the present exemplary embodiment and the structure of the above-described first exemplary embodiment resides in that an axial positioning part is set in a stepped part 36 between abutting surfaces 22*a* composed of two parallel surfaces forming a shape of width across flats and an outer peripheral surface 2*a* of the round connecting terminal 2'.

Further, a large difference in a connector 1' between the structure of the present exemplary embodiment and the structure of the above-described first exemplary embodiment resides in that a circumferential engaging part 35' provided in a slider 33 protrudes so as to traverse a slide direction of the slider 33 and a regulating surface 35*c* forming the circumferential engaging part 35' is set so as to be orthogonal to the slide direction of the slider 33.

Similarly to the above-described first exemplary embodiment, a housing 3 includes, in a terminal accommodating hole 30, an engaging lance 31 having a flexible arm 31*a* with a flexibility as an axial engaging part and an engaging part 31*b* provided at an end of the flexible arm 31*a* and set so as to protrude in and retreat from the terminal accommodating hole 30 when the flexible arm 31*a* is bent. Further, the engaging lance 31 is provided, in a corner part facing the round connecting terminal 2', with a guide inclined surface 31*c* formed obliquely relative to a direction in which the flexible arm 31*a* is bent.

Then, when the round connecting terminal 2' is inserted into the terminal accommodating hole 30, the engaging lance 31 retreats to a wall surface of the terminal accommodating hole 30, and when the stepped part 36 appears, the engaging lance 31 protrudes in the terminal accommodating hole 30 to be engaged with the stepped part 36.

In the above-described structure, the round connecting terminal 2' is inserted into the terminal accommodating hole 30 until the round connecting terminal is butted against an end part of the terminal accommodating hole 30. Thus, as shown in FIG. 17A, a circumferential positioning part 22 of the round connecting terminal 2' is accommodated in a U shaped groove 34 of the slider 33. Then, when a longitudinal direction of the circumferential positioning part 22 is substantially parallel to a vertical direction of the drawing, if the slider 33 is moved upward in the terminal accommodating hole 30 side, an upper end of the abutting surface 22*a* of round connecting terminal 2' abuts on the guide inclined surface 31*c* of the engaging lance 31 to apply a counterclockwise turning force or torque. Thus, the round connecting terminal 2' rotates on an axis as a center. Further, when the slider 33 is moved, a lower end of the abutting surface 22*a* is pushed up by the regulating surface 35*c* of the slider 33 so that the circumferential positioning part 22 is rotated in the U shaped groove 34. Finally, when the slider 33 is moved to a moving end, as shown in FIG. 17B, the circumferential positioning part 22 abuts on the regulating surface 35*c* of the circumferential engaging part 35. Thus, the abutting surface 22*a* of the circumferential positioning part 22 is arranged in orthogonal to the slide direction of the slider 33 and the round connecting terminal 2' is set at a prescribed rotating position. Then, the axial positioning part of the stepped part 36 formed between the outer peripheral surface 2*a* of the round connecting terminal 2' and the abutting surface 22*a* is engaged with the engaging lance 31 in the terminal accommodating hole 30 to prevent the round connecting terminal 2' from slipping out from the terminal accommodating hole 30.

As described above, in the present exemplary embodiment, when the round connecting terminal 2' is attached to the housing 3, the round connecting terminal 2' can be easily inserted into the terminal accommodating hole 30 of the housing 3 without caring about a directional performance or orientation with respect to a rotating position in the circumferential direction. Further, the slider 33 is moved to set the round connecting terminal 2' at a prescribed rotating position, so that a spring member 27 effectively operates which holds a connecting state to a male type terminal of a mate side. Accordingly, the terminals can be assuredly connected together by the spring member 27.

Further, since the axial positioning part is set by the stepped part 36 between the abutting surface 22*a* and the outer peripheral surface 2*a* of the round connecting terminal 2', an axial dimension of the round connecting terminal 2' can be shortened to make an entire part of the connector compact.

Further, since the round connecting terminal 2' has a substantially circular form in section and the axial positioning part is an annular groove along the circumferential direction, there is no protruding part in the circumferential direction, so that the connecting terminal can be more smoothly rotated in the circumferential direction. Further, since a clearance between the round connecting terminal 2' and an inner wall of the terminal accommodating hole 30 can be formed to be small, the round connecting terminal 2' accommodated in the terminal accommodating hole 30 does not shake. Thus, a connection to the male type terminal of the mate side can be assuredly achieved.

Further, since an electric wire connecting part 20 is formed in a cylindrical shape and an occurrence of an edge on a surface due to a caulking work is suppressed, the round connecting terminal 2' can smoothly pass through a seal material (not shown in the drawing) when the round connecting terminal 2' is attached to and detached from the housing (not shown in the drawing) and the seal material is not broken to hold a sealing performance. Accordingly, the seal material does not need to be exchanged and the round connecting terminal 2' can be attached to and detached from the housing. Further, a coating part 4*a* of an electric wire 4 does not need to be removed (what is called, a peeling) and the round connecting terminal 2' can be electrically connected to a conductor part 4*b* of the electric wire 4. Accordingly, a labor can be more reduced and a cost can be more suppressed than a case that the coating part 4*a* of the electric wire 4 is previously removed.

INDUSTRIAL APPLICABILITY

According to the present invention, the connector can be provided in which the connecting terminal can be easily inserted into the terminal accommodating hole of the housing and the terminals can be assuredly connected together even when the terminal of the mate side has a directional performance or orientation with respect to the rotating position in the circumferential direction.

This application is based on Japanese Patent Application No. 2008-259353 filed on Oct. 6, 2008 and Japanese Patent Application No. 2009-013423 filed on Jan. 23, 2009 and contents thereof are incorporated herein as references.

REFERENCE SIGNS LIST 1 connector
2 sound connecting terminal
3 housing
22 circumferential positioning part
22*a* abutting surface
23 groove part
30 terminal accommodating hole
31 engaging lance
32 slide hole
33 slider
35 circumferential engaging part
36 stepped part

The invention claimed is:

1. A connector comprising:

a terminal having a terminal main body, an axial positioning part provided on an outer periphery of the terminal main body as a recessed part and a circumferential positioning part provided in the terminal main body and having two parallel abutting surfaces;

a housing having a terminal accommodating hole that accommodates the terminal and has an axial engaging part, the axial engaging part extending in the accommodating hole, and a slide hole vertically connected to the accommodating hole; and a slider fitted to the slide hole so as to freely slide and having a circumferential engaging part, and wherein the circumferential engaging part protrudes in the accommodating hole and has a regulating surface, and the circumferential engaging part abuts on one of the abutting surfaces so that the abutting surfaces are parallel to the regulating surface when the slider slides in the slide hole.

2. The connector according to claim 1, characterized in that the connecting terminal has a substantially circular form in section, the axial positioning part has a annular groove continuing along the circumferential direction, the axial positioning part and the circumferential positioning part are adjacently arranged in the axial direction, the regulating surface is formed in parallel with a slide direction of the slider, and when the slider is slid to the terminal accommodating hole side in a state that the connecting terminal is held in the terminal accommodating hole, the abutting surface is held in parallel to the slide direction of the slider.

3. The connector according to claim 1, characterized in that the connecting terminal has a substantially circular form in section, the axial positioning part is set in a stepped part between the abutting surface and an outer peripheral surface of the connecting terminal, the regulating surface is formed so as to be orthogonal to the slide direction of the slider, and when the slider is slid to the terminal accommodating hole side in a state that the connecting terminal is held in the terminal accommodating hole, the abutting surface is held so as to be orthogonal to the slide direction of the slider.

4. The connector according to claim 1, wherein the slider has a U shaped groove extended along the axial direction, the circumferential engaging part is provided in one corner of the U shaped groove so as to have a substantially rectangular form in section, and the regulating surface is a surface parallel to the slide direction of the slider.

5. The connector according to claim 4, wherein one side of the regulating surface which is parallel to the slide direction has a length half or more as long as a longitudinal dimension of the abutting surface.

6. The connector according to claim 1, wherein the slider has a U shaped groove extended along the axial direction, the circumferential engaging part is provided in the U shaped groove so as to traverse the slide direction, and the regulating surface is a vertical surface to the slide direction of the slider.

* * * * *